US010828763B2

(12) United States Patent
Püttmann et al.

(10) Patent No.: US 10,828,763 B2
(45) Date of Patent: Nov. 10, 2020

(54) PERCUSSION DRILLING DEVICE

(71) Applicant: TRACTO-TECHNIK GmbH & Co. KG, Lennestadt (DE)

(72) Inventors: Franz-Josef Püttmann, Lennestadt (DE); Sadri Samadraxha, Kirchhundem (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 138 days.

(21) Appl. No.: 15/524,202

(22) PCT Filed: Nov. 4, 2015

(86) PCT No.: PCT/EP2015/002204
§ 371 (c)(1),
(2) Date: May 3, 2017

(87) PCT Pub. No.: WO2016/070987
PCT Pub. Date: May 12, 2016

(65) Prior Publication Data

US 2017/0334052 A1 Nov. 23, 2017

(30) Foreign Application Priority Data

Nov. 4, 2014 (DE) ..... 10 2014 016 154

(51) Int. Cl.
*E21B 4/06* (2006.01)
*B25D 9/26* (2006.01)
(Continued)

(52) U.S. Cl.
CPC ..... *B25D 9/26* (2013.01); *B25D 9/12* (2013.01); *E21B 1/38* (2020.05); *E21B 4/06* (2013.01);
(Continued)

(58) Field of Classification Search
CPC ... E21B 4/06; E21B 4/14; E21B 4/145; E21B 10/25; E21B 10/36; E21B 10/40;
(Continued)

(56) References Cited

U.S. PATENT DOCUMENTS 4,133,395 A * 1/1979 Schmidt ..... E21B 4/20 175/22
4,221,157 A * 9/1980 Schmidt ..... E21B 4/145 91/416
(Continued)

FOREIGN PATENT DOCUMENTS

DE 10112985 A1 10/2002
DE 102005051585 A1 5/2006
(Continued)

OTHER PUBLICATIONS

International Search Report dated Mar. 9, 2016 for related PCT Application No. PCT/EP2015/002204.

*Primary Examiner* — Scott A Smith
(74) *Attorney, Agent, or Firm* — Howard IP Law Group, PC

(57) ABSTRACT

A percussion drilling device for drilling in earth includes at least one housing section for a main piston, and a ring insert arranged in the housing section in front of the main piston so that the ring insert transmits at least part of the energy of the main piston onto the housing. The ring insert is attached to the housing by a shrink-fit connection.

18 Claims, 4 Drawing Sheets

(51) Int. Cl.

| | |
|---|---|
| ***E21B 1/38*** | (2006.01) |
| ***B25D 9/12*** | (2006.01) |
| *E21B 4/14* | (2006.01) |
| *E21B 6/00* | (2006.01) |
| *E21B 44/00* | (2006.01) |

(52) U.S. Cl.
CPC ..... *E21B 4/145* (2013.01); *E21B 6/00* (2013.01); *E21B 44/00* (2013.01)

(58) Field of Classification Search
CPC . E21B 7/26; E21B 17/03; E21B 17/04; E21B 17/0426; E21B 17/043; E21B 17/005; E21B 17/067; B25D 9/12; B25D 9/26
USPC ..... 173/91, 118, 128, 210, 211, 115, 133; 175/19, 296, 320, 390
See application file for complete search history.

(56) References Cited

U.S. PATENT DOCUMENTS 4,938,297 A * 7/1990 Schmidt ..... E21B 4/145 173/133
5,010,965 A * 4/1991 Schmelzer ..... E21B 4/145 175/19
5,979,570 A * 11/1999 McLoughlin ..... E21B 47/18 175/24
6,273,201 B1 * 8/2001 Randa ..... E21B 4/14 175/19
6,371,223 B2 * 4/2002 Wentworth ..... E21B 4/14 173/135
6,406,215 B1 * 6/2002 Balve ..... E21B 4/145 285/305
7,093,677 B2 * 8/2006 Hofmann ..... E21B 4/14 175/299
7,954,565 B2 * 6/2011 Puttmann ..... E21B 4/14 166/242.6
8,011,443 B2 * 9/2011 Meixner ..... B25D 11/125 173/118
8,235,148 B2 * 8/2012 Puttmann ..... E21B 4/14 175/320
8,360,174 B2 * 1/2013 Hall ..... E21B 7/067 175/320
8,499,857 B2 * 8/2013 Hall ..... E21B 10/62 175/385
9,016,404 B2 * 4/2015 Puttmann ..... E21B 4/06 173/115
9,328,560 B2 5/2016 Püttmann
2004/0112638 A1 6/2004 Hofmann
2006/0096769 A1 5/2006 Randa
2009/0283285 A1 11/2009 Randa
2012/0228031 A1 9/2012 Püttmann et al.
2013/0025936 A1 1/2013 Püttmann

FOREIGN PATENT DOCUMENTS

DE 102009038383 A1 3/2011
DE 102010015465 A1 10/2011
WO 2011023350 A1 3/2011
WO 2011128045 A2 10/2011

* cited by examiner

PERCUSSION DRILLING DEVICE

CROSS-REFERENCE TO RELATED APPLICATIONS

This application is a national phase application under 35 U.S.C. § 371 of International Patent Application No. PCT/EP2015/002204 filed Nov. 4, 2015, which claims priority to German Application No. 10 2014 016 154.4 filed Nov. 4, 2014, the entire contents of all of which are incorporated herein by reference for all purposes.

FIELD OF THE INVENTION

The invention concerns a percussion drilling device, as well as a method for manufacturing a percussion drilling device.

BACKGROUND OF THE INVENTION

Percussion drilling devices are known from the prior art and are used in particular for creating horizontal earth boreholes. Percussion drilling devices are self-driven drilling devices. A percussion drilling device of this kind comprises usually a main piston that oscillates backwards and forwards inside a housing, wherein said main piston impacts either on a front or rear impact surface of the housing, depending on the movement direction of the percussion drilling device. The kinetic energy transferred by the main piston causes the acceleration of the percussion drilling device in the ground.

A percussion drilling device of this kind is known, for example, from DE 10 2009 038 383 A1. The housing of the percussion drilling device known from DE 10 2009 038 383 A1 is made in two parts. In one part, the rear part, the main piston oscillates. The other part, the front part, comprises the drilling head and is impacted by the main piston. The two parts are joined by means of friction welding. The rear part is usually made from mild steel which, for the manufacture of a housing section of the percussion drilling device has a predetermined internal diameter. The front section is usually machined from solid, higher-grade steel due to the forces imparted by the main piston. After friction welding it is necessary to machine the friction weld seam so that the piston can move forward without any resistance, which is time-consuming. After machining the friction weld seam, the external contour of the housing is machined so that all threads and other contours are on the same axis.

SUMMARY OF THE INVENTION

It is now the object of the invention to improve a percussion drilling device and a method for manufacturing a percussion drilling device in such a way that a simpler design is possible.

Said object is met by the embodiments disclosed herein. Advantageous embodiments are described herein, and they become apparent from the following description of the invention.

The central idea of the invention is to provide a ring insert in the housing in the impact section of the piston, which reduces the open cross-section of the housing in the vicinity of the end of a drilling head tip that is impacted by the main piston.

It was recognized that a section of the housing, which is impacted by the main piston and which may be provided with the impact surface for the main piston, does not need to be made in one piece with the housing despite the great mechanical stress. According to the invention the external and the internal contour of the percussion drilling device can be made separately from the ring insert that has been inserted or will be inserted. Until now the consideration has been that the entire front section had to be made from a higher-grade material with a one-piece connection between the outer contour and the impact surface for the piston. This entrenched consideration has been proven wrong. The ring insert is disposed in the housing in such a way that it transfers at least part of the energy of the main piston onto the housing. The ring insert itself may be provided with an impact surface for the main piston and thus transfer the mechanical energy of the main piston when it contacts the impact surface. The mechanical energy may also be transferred indirectly onto the ring insert, for example by means of the drilling head or the drill tip that is impacted by the main piston.

Thus, the commonly used friction welding becomes obsolete according to the invention. This has a number of advantages. For example, the housing may be made from one pipe. The time-consuming and expensive machining of the friction welding seam is no longer required. The friction welding, which has so far been contracted to a third-party supplier, is no longer necessary. The manufacturing time is reduced. The otherwise necessary mechanical processing, for example honing after the usual friction welding, is no longer required.

The ring insert may be disposed in the vicinity of the impact surface for the main piston. Moreover, the ring insert may be provided with the impact surface for the main piston of the percussion drilling device. The respective housing section no longer requires any mechanical processing after placement of the ring insert. The ring insert may also be rigidly or moveably connected with the drilling head tip, wherein also the drilling head tip may be provided with the impact surface for the main piston, which in turn transmits the mechanical energy of the main piston onto the ring insert and thus onto the housing.

A "percussion drilling device" is understood to be in particular any equipment that is moved intermittently in an existing conduit or in one yet to be established, so as to produce or enlarge a borehole, or to replace or clean an existing pipe destructively or non-destructively, to install services in existing pipes or other elongated bodies, as well as all devices for construction work involving underground advance. A percussion drilling device according to the invention may in particular be a self-driven impact device for producing a horizontal borehole.

The term "percussion drilling device" also includes soil displacement devices wherein the drilling head tip is rigidly attached to the housing, as well as a percussion drilling device with a drilling head tip that is supported and axially moveable independent from the housing. The drilling head tip may in particular be a chisel. A percussion drilling device according to the invention may be a one-stroke device or a two-stroke device. In a two-stroke device the main piston impacts initially on the drilling head tip, which runs ahead in the first stroke. The housing is impacted in the second stroke by the main piston. In a two-stroke device the tip resistance and surface friction are overcome separately and alternately more easily. The two-stroke device exhibits a better energy conversion, which makes in particular the comminution of obstacles easier due to the concentration of the percussion impulse onto the drill head tip. Because the earth displacement runs ahead a distance corresponding to the stroke length of the drilling head, the housing remains in a steady position and thus ensures a relatively good driving stability.

The percussion drilling device in terms of the invention is not limited to underground earthworks. It is possible, for example, that a ground drilling device is used in pipes that are located above ground.

The term "horizontal drill hole" in terms of the invention includes in particular any kind of existing or yet to be established, preferably horizontal passage in a body, in particular earth passages including earth boreholes, rock boreholes or earth conduits as well as underground or aboveground pipes and sewage channels, which may be produced, expanded, destroyed, cut open or cleaned by means of using a percussion drilling device.

The term "ring insert" is not limited to the classic ring shape. Thus it may, instead of the circular shape, have a different shape or it may be discontinuous. The ring insert may in particular be provided with an outer contour that matches essentially the inner contour of the section into which the ring insert is fitted. It may be provided that the outer contour shape of the ring insert has an envelope that matches essentially the inner contour shape of the section into which the ring insert is fitted. The ring insert may in particular be provided with an opening that is preferably disposed centrally.

The ring insert is retained in the section by means of a shrink-fit. This provides a very simple and cost-effective means for retaining the ring insert in the section, or to connect it to said section respectively. In this embodiment of the invention the ring insert has an outer contour that is of a larger dimension than a corresponding measurement of the inner contour of the housing section, when the ring insert is not located inside the housing section. The ring insert may be disposed in the housing section in that a temperature difference is generated between the ring insert and the housing section, through which the internal diameter is temporarily enlarged and/or the outer contour is temporarily reduced in size. This may be achieved, for example, by means of externally applied heat or through chilling the inside. The term "shrink-fit" includes any kind of connection that offers the possibility of fitting the marginally larger ring insert in the internal diameter of the housing section. A shrink-fit is caused by an oversize of the components that are fitted together.

The section in which the ring insert is retained is advantageously of a circular diameter. This can simplify the manufacturing process since the ring insert is rotation-invariant to the section. A preferred position when fitting the ring insert is not necessary.

The ring insert may also form part of the drilling head, or it may be separate from the same. The ring insert may be disposed at the end of the drilling head. The ring insert may be disposed in particular at the end of the housing section of the drilling head or the drilling head tip respectively. The ring insert placed at the end of the housing section may be inserted in front of the housing section for the main piston.

In a preferred embodiment the ring insert comprises a material that is different from that of the housing. This opens up the possibility of taking into account the individual requirements of the ring insert, which may be provided with an impact surface for the main piston, as well as the individual requirements of the housing. The term "comprises" includes, in terms of the invention, that a material or a component respectively is present (the literal sense of the term), but also that the element in question is made of this material, wherein possible contaminations or residual constituents may be present.

In a preferred embodiment the percussion drilling device is provided with a ring insert of a material that is heat-treated. By way of the heat treatment it is possible, for example, to establish varying characteristics depending on which heat treatment the material was subjected to. Different heat treatments may lead to different characteristics. The heat treatment may be such that a drastic structural transformation (annealing or hardening) and/or surface transformations of a work piece only (diffusion process or coating techniques) is caused. The different heat treatment methods can be verified, for example, by way of a micrograph.

Neither the above descriptions nor the following descriptions of exemplary embodiments constitute a relinquishment of certain embodiments or characteristics.

BRIEF DESCRIPTION OF THE DRAWINGS

The invention will now be described in more detail by way of the exemplary embodiments shown in the drawings. Shown are in.

DETAILED DESCRIPTION

Figure 1:
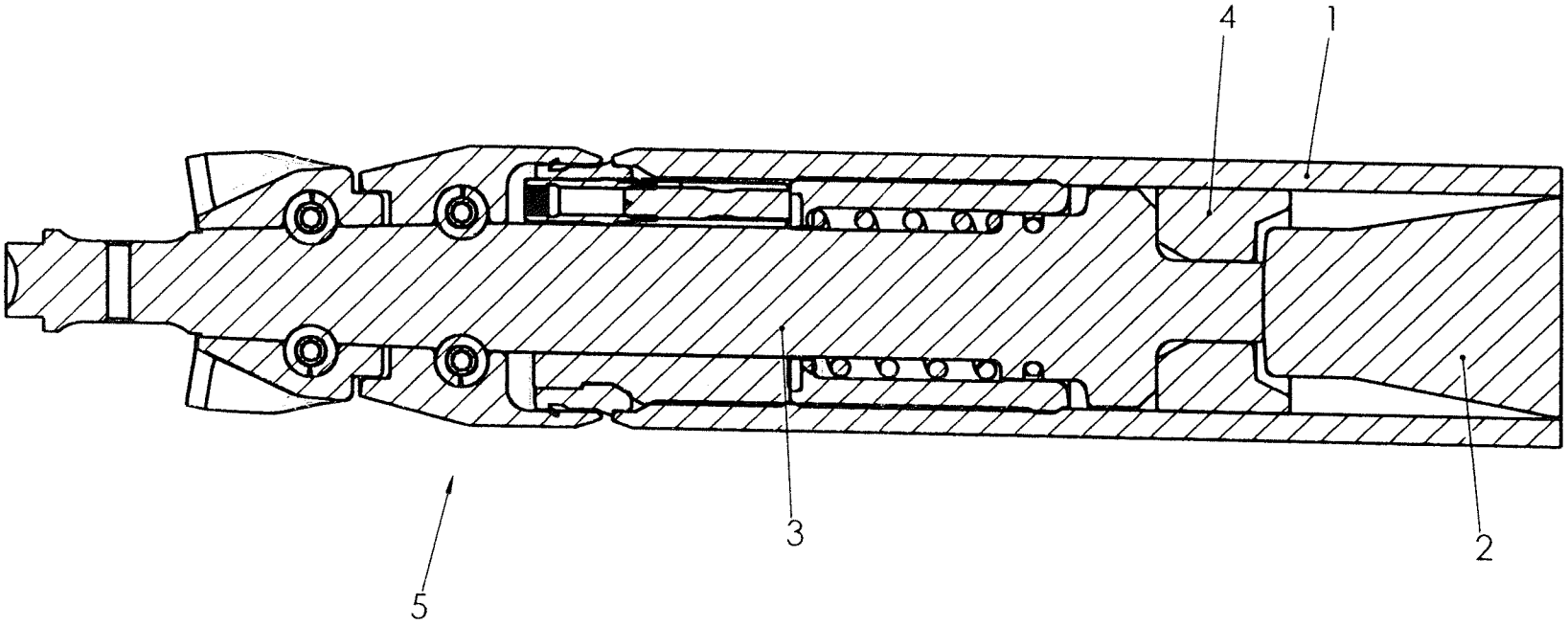
FIG. 1 shows a front section of a percussion drilling device according to the invention in a cross-section of a side elevation of a first embodiment.

FIG. 1 depicts the front section of a percussion drilling device according to the invention in a cross-section of a side elevation. FIG. 1 depicts a first embodiment. The percussion drilling device is provided in this section with a housing 1 in which a main piston 2 is supported in a manner allowing it to oscillate. The main piston 2 is brought into an oscillating movement in a manner known per se using compressed air, which is supplied to the percussion drilling device at its rear end (not shown) via a compressed air line, where the percussion drilling device, in operation, impacts in every cycle of its movement a front striking surface.

The percussion drilling device shown in FIG. 1 is a percussion drilling device that operates according to the two-stroke principle. The main piston 2 impacts in two stages, initially on a drilling head tip 3, which is designed as a chisel, and then on an insert or ring insert 4 respectively inside housing 1. The drilling head tip 3 is axially supported inside the drilling head 5 in a moveable manner, independent from the housing 1. One end of the drilling head tip 3 extends through a reduced cross-section inside the section of the housing 1 that is formed by the ring insert 4. The ring insert 4 comprises the impact surface for the main piston 2. The impact surface is designed as the base area of a conically tapered, hollow space inside ring insert 4.

In the section with the ring insert 4 the housing 1 is designed to have a circular inner contour with an internal diameter. The ring insert 4 is provided with a circular outer contour with an external diameter. The external diameter of ring insert 4 is slightly larger than the internal diameter of the housing 1 provided that ring insert 4 and housing 1 are at the same temperature when located in the section under consideration. To be able to fit the ring insert 4 into the housing 1, the housing 1 may have been heated up and/or the ring insert 4 may have been cooled down. In this manner it is possible to fit the ring insert 4 in the desired position in housing 1. After cooling down and heating up respectively of the housing 1 and the ring insert 4 respectively to the same temperature, the ring insert 4 is fixed in position inside housing 1.

The drilling head 5 may correspond to the drilling head of a percussion drilling device disclosed in WO 2011/128045 A2. In this respect reference is made to WO 2011/128045 A2 in its entirety.

Figure 2:
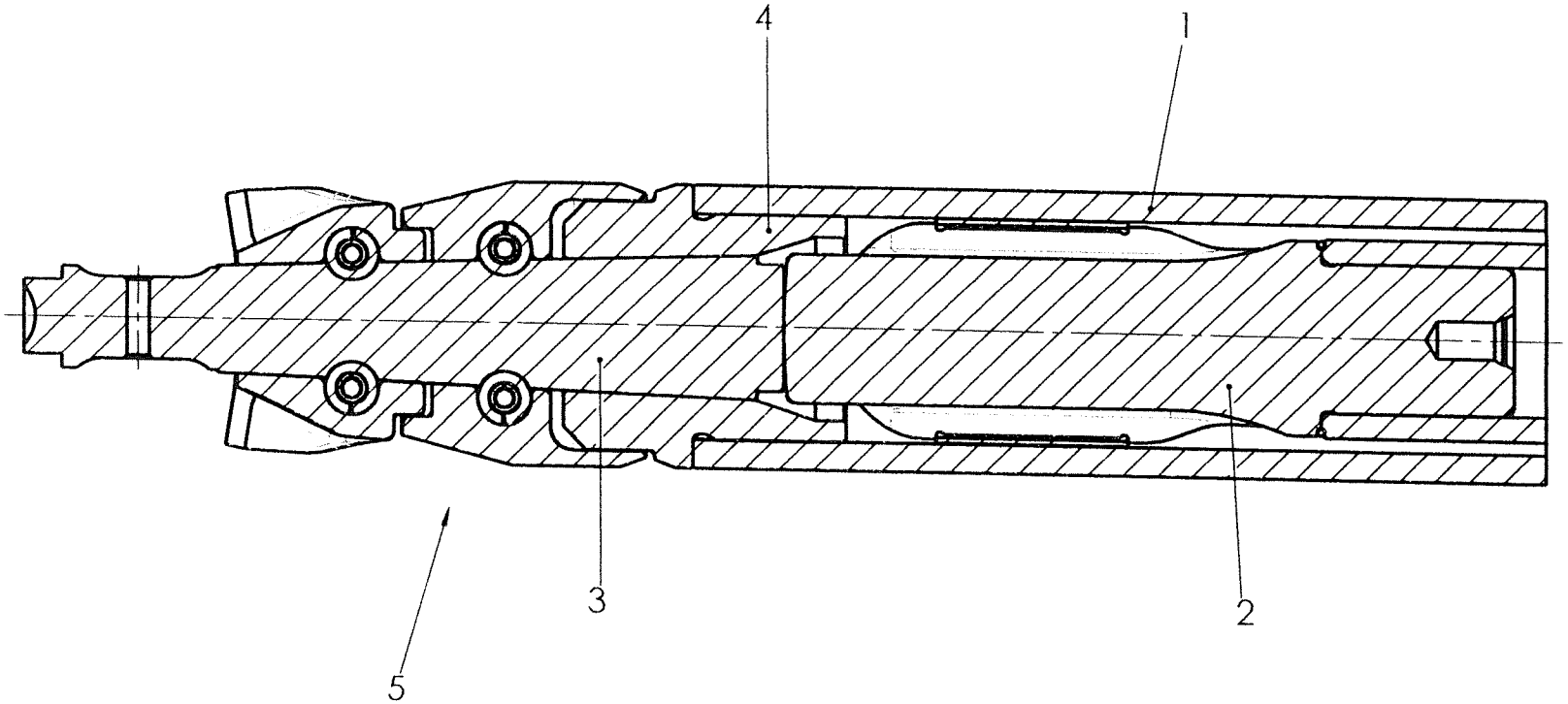
FIG. 2 shows a front section of a percussion drilling device according to the invention in a cross-section of a side elevation of a second embodiment.

FIG. 2 depicts an alternative embodiment with a drilling head 5 inserted into the end of housing 1, wherein said drilling head 5 is provided with an insert or ring insert 4 respectively, which was fitted into the housing 1 to reduce the cross-section and to form an impact surface for the main piston. The ring insert 4 was fitted into the end section of housing 1 by way of shrink-fitting. One end of the drilling head tip 3 extends through the ring insert 4. The drilling head tip 3 is guided at the end and is provided with an impact surface for the main piston 2. The embodiment shown in FIG. 2 operates according to the one-stroke principle.

Figure 3:
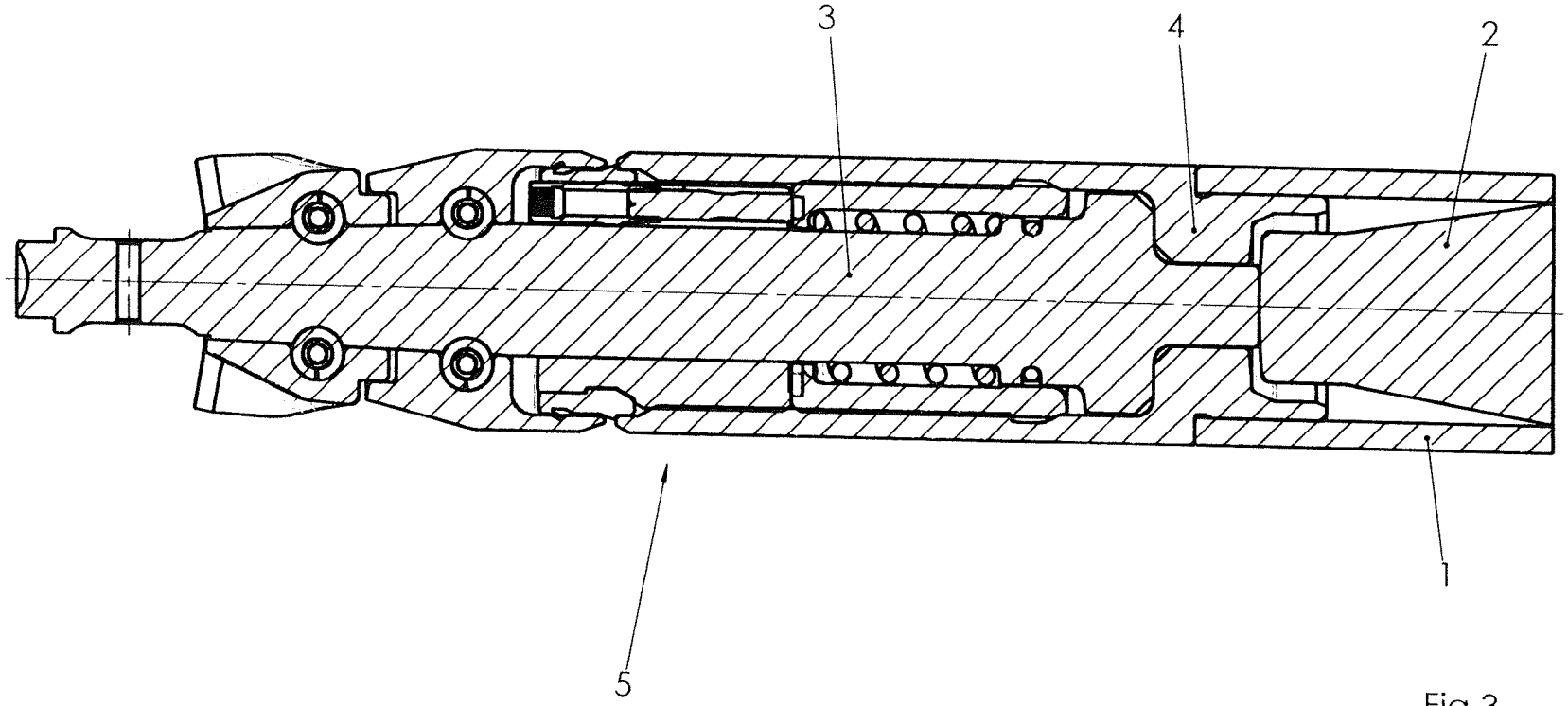
FIG. 3 shows a front section of a percussion drilling device according to the invention in a cross-section of a side elevation of a third embodiment.

FIG. 3 shows an alternative embodiment in which a ring insert 4, which is part of drilling head 5, has been inserted into the end of housing 1. The ring insert 4 of FIG. 3 is the end section of a front housing or drilling head 5 respectively, which was shrink-fitted and which comprises an axially supported, moveable drilling head tip 3 that moves independent from housing 1. The embodiment depicted in FIG. 3 operates according to the two-stroke principle. The ring insert 4 and the drilling head tip 3 are each provided with an impact surface for the main piston 2 onto which the main piston 2 impacts consecutively in a forward movement. Concerning the design of the drilling head 5 of the embodiment shown in FIG. 3, reference is made in this respect to WO 2011/128045 A2 in its entirety.

Figure 4:
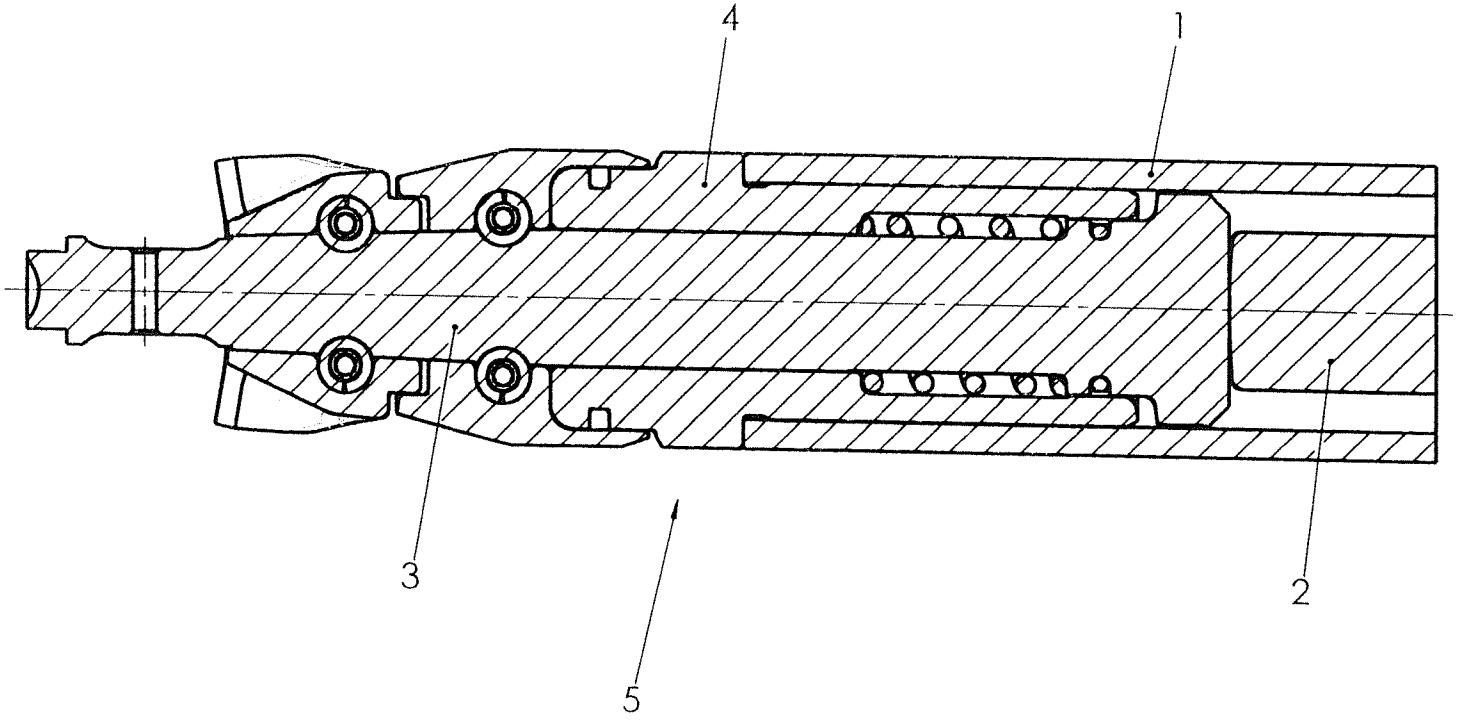
FIG. 4 shows a front section of a percussion drilling device according to the invention in a cross-section of a side elevation of a fourth embodiment.

FIG. 4 depicts an alternative embodiment in which a ring insert 4, which is part of drilling head 5, has been inserted into the end of housing 1. The ring insert 4 of FIG. 4 is the end section of a front housing or drilling head 5 respectively, which was shrink-fitted and which comprises an axially supported, moveable drilling head tip 3 that moves independent from housing 1. A compression spring is disposed between the drilling head tip 3 and the ring insert 4, which is compressed when the main piston 2 impacts on the drilling head tip 3. The drilling head tip 3 comprises an impact surface for the main piston 2. As a result of the impact by the main piston 2 on the drilling head tip 3, the drilling head tip 3 may impact on ring insert 4 after the spring located between the drilling head tip 3 and the ring insert 4 has been partially compressed. The embodiment depicted in FIG. 4 operates according to the two-stroke principle. The main piston 2 impacts first on the drilling head tip 3. After a sufficient compression of the spring, the drilling head 3 impacts on the ring insert 4 due to the impulse transmitted by the main piston 2.

The invention claimed is:

1. A percussion drilling device for drilling in earth, comprising:

at least one housing section for a main piston; and a ring insert arranged in the housing section in front of the main piston, and attached to the housing section by a shrink-fit connection, wherein the ring insert is arranged one of: (1) around an adjacent end of a drilling head tip configured to be directly impacted by the main piston when the main piston is driven in the forward direction, or (2) forward of a shoulder defined at one end by an anvil end of the drilling head tip, the shoulder configured to directly impact the ring insert, wherein the ring insert is configured to transmit at least part of the energy of the main piston onto the housing section.

2. The percussion drilling device according to claim 1, wherein:

the housing section has an internal contour, wherein, when the housing section and the ring insert are at the same temperature, and the ring insert is external to the housing section, the internal contour of the housing section is smaller than an outer contour of the ring insert.

3. The percussion drilling device according to claim 1, wherein the housing section has a circular diameter.

4. The percussion drilling device according to claim 1, wherein the ring insert comprises an opening for the drilling head tip, and a base area defining a conically tapering, hollow space.

5. The percussion drilling device according to claim 1, wherein the ring insert is ring-shaped.

6. The percussion drilling device according to claim 1, wherein the ring insert is disposed at least in part in the housing section for the drilling head tip.

7. The percussion drilling device according to claim 1, wherein the ring insert is made of a first material, and the housing section is made of a second material different from the first material.

8. The percussion drilling device according to claim 1, wherein the ring insert is made of a heat treated material.

9. The percussion drilling device according to claim 1, wherein the ring insert is arranged around the adjacent end of the drilling head tip configured to be directly impacted by the main piston when the main piston is driven in the forward direction.

10. The percussion drilling device according to claim 1, wherein the ring insert is arranged forward of the shoulder defined at one end by the anvil end of the drilling head tip, the shoulder configured to directly impact the ring insert, wherein the ring insert is configured to transmit at least part of the energy of the main piston onto the housing section.

11. A method for the manufacture of a percussion drilling device for drilling in earth, comprising:

inserting a ring insert in a housing section of the percussion drilling device, in front of a section for a main piston, and arranging the ring insert one of: (1) around an adjacent end of a drilling head tip configured to be directly impacted by the main piston when the main piston is driven in the forward direction, or (2) forward of a shoulder defined at one end by an anvil the end of the drilling head tip, the shoulder configured to directly impact the ring insert; and attaching the ring insert to the housing section by a shrink-fit connection, so that, responsive to forward motion of the main piston, the ring insert transmits at least part of the energy of the main piston onto the housing section.

12. The method for the manufacture of the percussion drilling device of claim 11, wherein attaching the ring insert to the housing section by the shrink-fit connection comprises generating a temperature difference between the ring insert and the housing section effective to cause at least one of a temporary increase in an internal diameter of the housing section, or a temporary reduction in size of an outer contour of the ring insert, sufficient to permit fitting of the ring insert into the housing section.

13. The method for the manufacture of the percussion drilling device of claim 12, wherein generating the temperature difference between the ring insert and the housing section comprises applying, to one or both of the ring insert or the housing section, heat or cold.

14. The method for the manufacture of the percussion drilling device of claim 11, wherein the ring insert is arranged around the adjacent end of the drilling head tip configured to be directly impacted by the main piston when the main piston is driven in the forward direction.

15. The method for the manufacture of the percussion drilling device of claim 11, wherein the ring insert is arranged forward of the shoulder defined at one end by the anvil end of the drilling head tip, the shoulder configured to directly impact the ring insert, wherein the ring insert is configured to transmit at least part of the energy of the main piston onto the housing section.

16. A percussion drilling device for drilling in earth, comprising:

at least one housing section for a main piston; and a ring insert arranged in the housing section in front of the main piston, and attached to the housing section by a shrink-fit connection, wherein the ring insert is arranged one of: (1) around an end of a drilling head tip configured to be directly impacted by the main piston when the main piston is driven in the forward direction, or (2) forward of a shoulder at the end of the drilling head tip which is configured to directly impact the ring insert, wherein the ring insert is configured to transmit at least part of the energy of the main piston onto the housing section.

17. The percussion drilling device of claim 16, wherein:

the housing section has an internal contour, wherein, when the housing section and the ring insert are at the same temperature, and the ring insert is external to the housing section, the internal contour of the housing section is smaller than an outer contour of the ring insert.

18. The percussion drilling device of claim 16, wherein the ring insert is made of a heat treated material.

* * * * *